United States Patent [19]

Bowyer

[11] Patent Number: 4,884,853

[45] Date of Patent: Dec. 5, 1989

[54] DRAWER INTERLOCKING MEANS FOR STORAGE CABINET

[75] Inventor: Stephen M. Bowyer, Fruitport, Mich.

[73] Assignee: Meridian, Inc., Spring Lake, Mich.

[21] Appl. No.: 225,351

[22] Filed: Jul. 28, 1988

[51] Int. Cl.[4] ..... E05C 7/06

[52] U.S. Cl. ..... 312/221

[58] Field of Search ..... 312/221, 220, 219, 215, 312/216, 217, 218, 222, 107.5

[56] References Cited

U.S. PATENT DOCUMENTS

| | | | |
|---|---|---|---|
| 3,188,160 | 6/1965 | Cornelius et al. | 312/220 |
| 3,454,320 | 7/1969 | Olree | 312/221 X |
| 4,298,236 | 11/1981 | Laroche | 312/221 X |
| 4,452,498 | 6/1984 | Wood, Jr. et al. | 312/221 X |
| 4,480,883 | 11/1984 | Young | 312/220 |
| 4,705,326 | 11/1987 | Craig | 312/221 |
| 4,732,434 | 3/1988 | Hartrum | 312/221 |
| 4,772,078 | 9/1988 | Bowyer | 312/220 X |

FOREIGN PATENT DOCUMENTS

| | | | |
|---|---|---|---|
| 3431386 | 3/1986 | Fed. Rep. of Germany | 312/221 |

*Primary Examiner*—Joseph Falk

*Attorney, Agent, or Firm*—Reising, Ethington, Barnard, Perry & Milton

[57] ABSTRACT

A file storage assembly having a string or stack of elements vertically disposed along one side to allow only one drawer to be opened at a time. A shaft (48) having inclined cam surfaces (50,52) at opposite ends is associated with each drawer and includes a pinion (44) rotated by engagement with a rack (46) on the drawer during opening of the drawer. Upon rotation of the shaft (48), the cam surfaces (50,52) at the ends thereof vertically move the shafts (48) of the other drawers to vertically move one of a pair of locking lugs (64) on the shafts (48) into horizontal alignment with a lug (78) on the drawer (38) to prevent opening of all other drawers. A key projection (66) extends from the housing between each pair of lugs (64) upon rotation of the shaft (48) during opening movement of the drawer to prevent vertical movement of the operative shaft (48). The pinion (44) includes four teeth on less than half of the circumstances for allowing any number of storage units (38) at one time to be initially installed in support by the housing 20 while the pinion (44) remains in its neutral and unlocked position. A reversing tab (45) on one of the lugs (64) prevents the pinion (44) from rotating out of coacting engagement with the rack (46) when opening or closing the storage unit (38).

30 Claims, 4 Drawing Sheets

DRAWER INTERLOCKING MEANS FOR STORAGE CABINET

TECHNICAL FIELD

The subject invention relates to file storage cabinets having stacked drawers, and more particularly to an interlocking assembly for allowing the withdrawal of only one drawer at a time while allowing installation of any number of drawers at one time without manually adjusting the locking mechanism.

BACKGROUND ART

File storage cabinets are used for filing documents and are generally of the vertical and lateral type. Such file cabinets usually include a number of file drawers vertically stacked with each file drawer being movable from within the cabinet housing to an extended open position to provide access to the drawer space. In a vertical file cabinet the length of the file drawer extends out of the file cabinet housing with the files extending across the drawer, whereas in a lateral file drawer the length of the drawer extends across the cabinet housing so that when the drawer is opened it is moved transverse to its length.

It very frequently occurs that if more than one drawer is moved to the open position at the same time, the file cabinet assembly has a tendency to tip forward in the opening direction of the drawers. In such cabinets which only allow one drawer to open, installation of the drawers within the cabinets is often difficult and requires manual intervention controlling the locking assembly. Many of these systems include mechanisms disposed along one side of the drawers for being moved to a locking position in response to opening movement of one of the drawers. Additionally, there are occasions in which the locking means when opened will disengage and require re-installation of the drawer by manually moving the locking means to properly engage the drawer when in the opened position.

U.S. Pat. No. 3,454,320 to Olree discloses a system having a rod with a radially extending actuating arm associated with each drawer for rotating the rod upon opening movement of the drawer to rotate a second locking arm associated therewith into interfering position with each of the other drawers. The actuating arm includes a sloping edge on the abutment means acting as a cam in raising the arm to allow the drawer to move into its closed position when the drawer is open and the locking arm closed. Only one drawer is allowed to move against the finger element to the closed position at a time. A major deficiency in this system is that it allows two drawers to rotate the rod simultaneously during opening movement of both drawers, and only one drawer to be installed at a time.

Another such assembly is disclosed in German patent DE 3431386 Al published Mar. 6, 1986 in the name of Anton Kessel. The patent discloses a stack of tubular members and tubular gears telescoped unto an inner tube with the bottom tubular member bottomed out or not movable vertically. Upon rotation of any one of the gears, only the stack above the rotated gear moves vertically upward as the stack below remains vertically fixed as the force reaction occurs at the bottom of the stack. This also requires manual intervention of rotating the gear in the open position in order to install the drawers.

My previous assembly includes vertically stacked elements which are vertically movable to drawer-locking positions in response to opening movement of one of the drawers. This assembly is disclosed in U.S. patent application Ser. No. 058,028, filed June 4, 1987, now U.S. Pat. No. 4,772078, and assigned to the assignee of this invention. The application discloses a housing having control means vertically disposed along side of each vertically stacked drawer. The control means includes a pinion gear having teeth about its circumference coacting with the drawer for rotating as the drawer is moved toward open to move blocking means of all other drawers to their blocking positions allowing only a single drawer to be opened at a time. The stack of blocking means above the rotated pinion moves vertically upward from a neutral position while the stack below the rotated pinion moves vertically downward from the neutral position. In order to initially install a drawer in the housing, the pinion must be moved to its actuated or open position for engagement with the drawer in its open position. Additionally, there are occasions when the pinion will rotate back to its neutral position while the drawer remains open; this requires manual intervention to rotate the pinion back to its actuated or open position in order to close the drawer.

SUMMARY OF THE INVENTION AND ADVANTAGES

A storage assembly comprising a housing means defining an enclosure with a plurality of storage units to be supported by the housing means for movement between a closed position within the enclosure and an open position extending out of the housing means. The assembly includes blocking means disposed on a vertical axis along side of the storage lo units for preventing opening movement from the closed position of all but one of the storage units in response to opening movement of one of the storage units. The blocking means includes control means associated with each storage unit movable between a neutral opening position and a blocking position for remaining in the neutral position during installation of any storage units to their closed position while allowing opening movement of the installed storage unit from its closed position moving all other control means to their blocking positions preventing opening movement of all other associated storage units.

The control means coacts with the associated storage unit for rotating the control means between an unactuated position when the associated storage unit is closed and actuated position preventing opening movement thereof when the storage unit is moving toward open, and limiting means for preventing the transmission means from rotating out of the unactuated position except in response to the storage unit rotating the transmission means to the actuated position. An advantage of utilizing a control means, which is movable to the blocking position in response to actuation of another control means by its associated drawer means, is the very secure blocked feeling of the drawers. Two drawers may be pulled simultaneously without any appreciable movement, i.e., a totally locked feeling. Drawers may be installed in the housing allowing the control means to remain in its neutral position without manually altering the positions of the control means. Also, the control means will remain in coacting engagement with the storage unit at all times.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
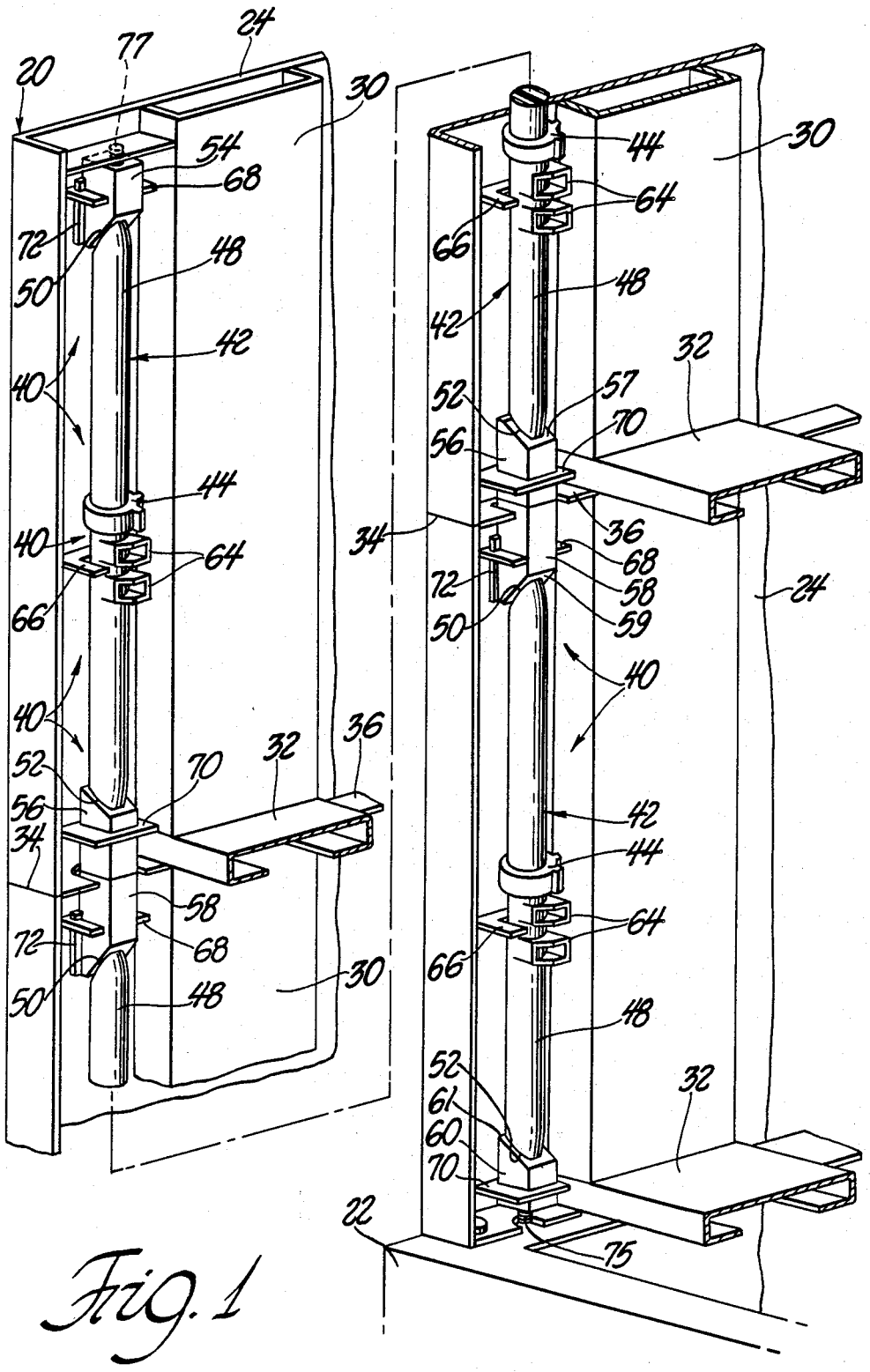
FIG. 1 is a fragmentary perspective view partially broken away and in cross section of a preferred embodiment of the subject invention.

The embodiment illustrated in FIGS. 1 through 5 is particularly suited for use in a lateral type file storage cabinet assembly.

Referring to the FIGURES where like numerals indicate like or corresponding parts throughout the several views, a storage assembly is shown as including a housing means generally indicated at 20 for defining an enclosure. The housing means 20 includes a bottom or base 22. Extending upwardly from the base are left (not shown) and right side walls 24 which are interconnected at the rear by a rear wall, not shown but readily understood and well-known in the art. A top wall, also not shown, extends across the left, right and rear walls to define the top of the enclosure. The housing means 20 also includes vertical side beams 30 and cross beams 32.

The housing means 20 is segmented into vertical drawer units stacked one upon the other at mating lines or seams 34 and flanges 36. These vertical segments or sections may be of various different vertical heights to accommodate drawers of various different vertical heights or depths. For example, some drawers may be of a vertical height for receiving the files of standard letter-size documents or for 3×5 or 5×8 index cards.

Figure 2:
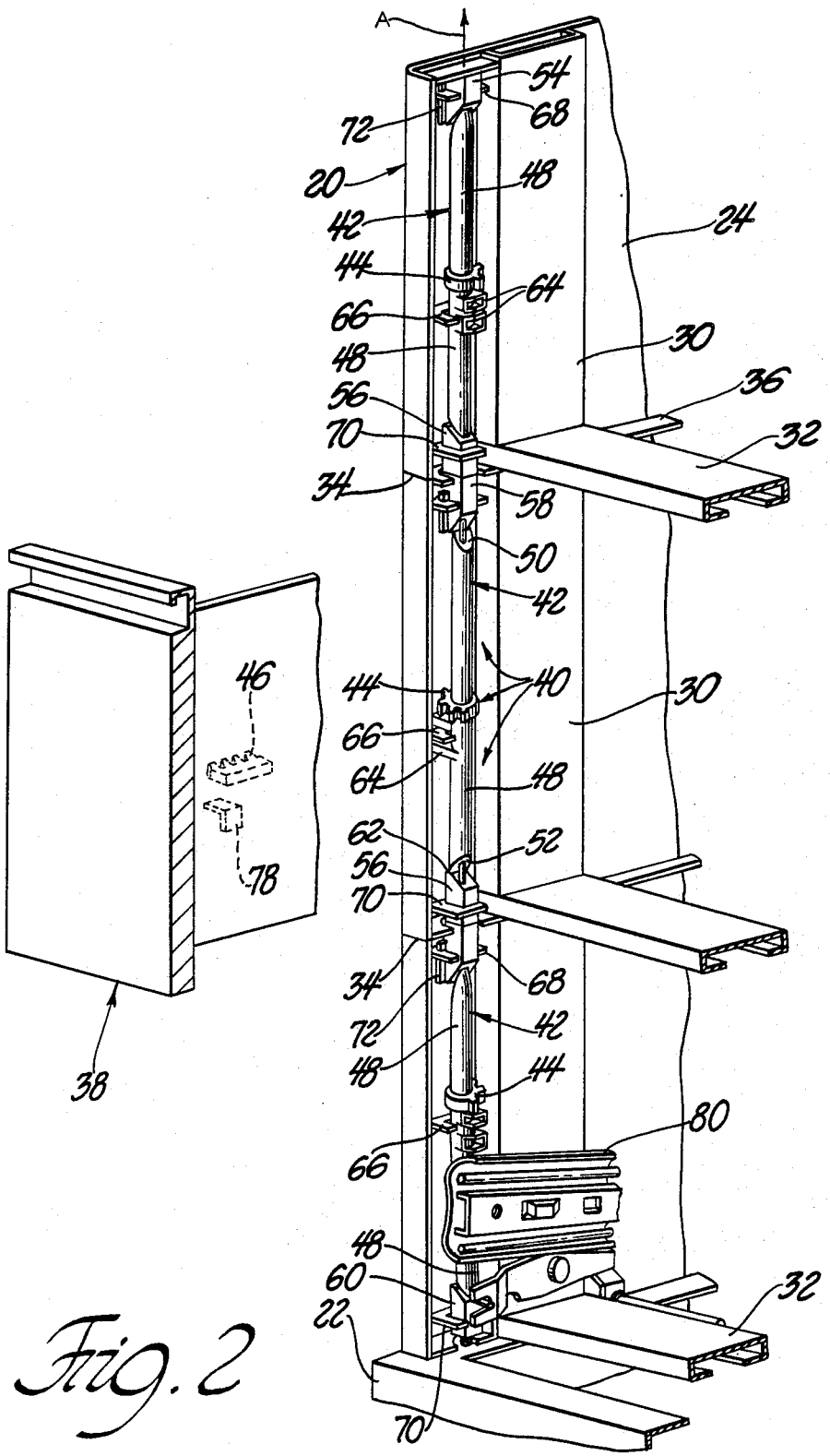
FIG. 2 is a fragmentary perspective view of the assembly shown in FIG. 1 to a different scale and with one of the drawers moved to the open position.

A plurality of storage drawer units are included but only one is generally indicated at 38 in FIG. 2. Each of the storage drawer units 38 is supported by a drawer slide hung from the housing means 20 for movement between a closed position within the enclosure and an open position as indicated in FIG. 2 extending out of the housing means 20.

The storage assembly includes blocking means generally shown at 40 disposed on a vertical axis A (as indicated in FIG. 6) along the left side of the storage units 38 for preventing opening movement from the closed position of all but one 38 of the storage units in response to opening movement of the one of the storage units 38. The blocking means 40 may be disposed on either side of the cabinet. The blocking means 40 includes a control means 42 associated with each storage unit 38. Each control means 42 is vertically movable between a neutral opening position allowing opening movement of the associated storage unit 38 and upper and lower blocking positions respectively vertically above and below the neutral opening position for preventing opening movement of the associated storage unit 38 in either of the blocking positions and for vertically moving all other control means 42 to their respective blocking positions while remaining in the neutral opening position in response to initial opening movement of the associated storage unit 38. The control means 42 remains in the neutral opening position during initial installment of the storage units 38 from being unsupported from the housing 20 to being supported by the housing 20. With any number of storage units ready installed and closed, the control means 42 will be in its neutral position and will remain there during installment of the storage unit 38 until a storage unit is moved toward open from its closed position. In other words, when the storage units are initially installed or placed into the housing 20, any number of units may be installed at the same time without being blocked. All of the control means 42 illustrated in FIG. 1 are disposed in the vertically neutral opening position for allowing opening movement of any one of the storage drawer units 38. As illustrated in FIG. 2, the center storage unit 38 has been moved to the open position and the associated center control means 42 has remained in the vertically neural opening position while vertically moving the top control means 42 vertically upwardly to the upper blocking position and the lower control means 42 downwardly to the lower blocking position for preventing opening movement of the top or bottom storage units.

Figure 4:
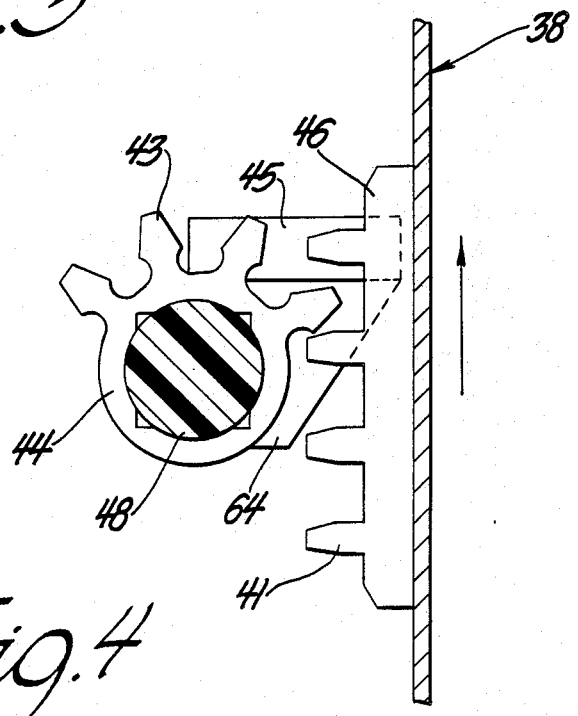
FIG. 4 is an top view of the pinion gear and rack in its ratcheting position.

Each control means 42 includes a transmission means comprising a pinion gear 44 coacting with a rack 46 on the associated storage unit 38 for rotating the control means 42 between an unactuated position, in which position all control means 42 are shown except the middle control means 42 in FIG. 2, and an actuated position, which is the position of the middle control means 42 in FIG. 2. Each drawer storage unit 38 includes a rack 46 disposed on the side thereof and extending lengthwise in the direction of the opening movement for engaging and forwardly rotating the pinion gear 44 of the associated control means 42 during opening movement thereof. The pinion gear 44 has a circumference and comprises gear teeth 43 extending therefrom on less than the full circumference of the pinion 44 to allow storage unit 38 to ratchet with the pinion gear 44 during initial installment to the closed position without causing the control means 42 to be placed in its blocking position, as indicated in FIG. 4. More specifically, the gear teeth 43 extend from the gear 44 on less than half of the circumference of the pinion 44. The rack 46 when moved in the direction of the arrow in FIG. 4 toward the installed and closed position will ratchet against the gear 44; the gear 44 is biased toward the neutral position as therein illustrated by the control means. In other words, as each tooth on the rack 46 contacts the tooth of the gear 44, the gear 44 will slightly reverse rotate from its neutral position allowing the rack tooth 43 to disengage therefrom and move forward at which time the gear 44 will rotate back to its neutral and unactuated position. Each rack tooth 41 will ratchet against the first gear tooth 43 in this manner without permanently rotating the gear from its neutral or unactuated position.

Figure 3:
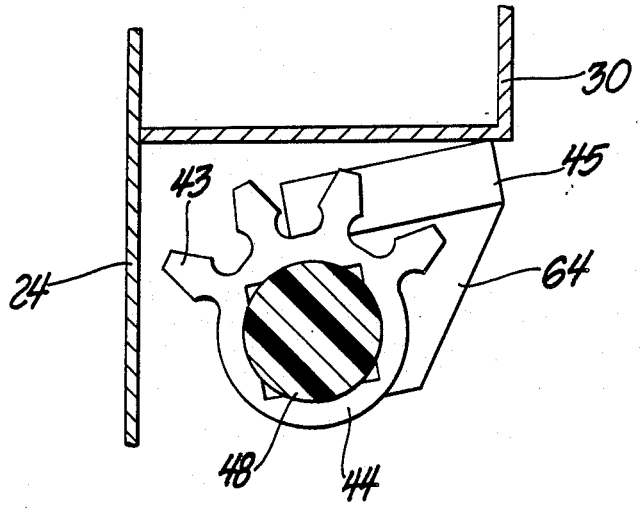
FIG. 3 is an top view of the pinion gear and reversing tab in its fully reverse rotated position.

The control means 42 includes limiting means 45 for preventing the control means 42 from reverse rotating to a non-coacting position between the gear 44 and rack 46. In other words, the limiting means 45 ensures that the gear 44 is never reverse rotated so that when opening a storage unit 38 the gear 44 and rack will engage and coact. During initial installment of the storage units 38 into and supported by the housing, the rack 46 ratchets with a portion of one of the gear teeth 43 of the pinion gear 44 in its unrotated or neutral position. The limiting means 45 prevents the control means 42 from being reverse rotated such that the gear teeth 43 will not coact with the rack teeth 41 upon opening of a storage unit 38. When the rack 46 is moved into the housing or closed position, the rack teeth 41 will ratchet with the gear teeth 43. If over reverse rotation begins to occur, the limiting means 45 contacts the vertical side beam 30 preventing the gear 44 from further reverse rotation, as illustrated in FIG. 3. Therefore, the limiting means 45 prevents the pinion from being rotated out of its non-coacting engagement or neutral and unactuated positions during initial installment for closing of a storage unit 38. Also, there are occasions when a storage unit 38 is open and the associated control means 42 will rotate back to its unactuated position causing all other control means 42 to move to their neutral positions. In this case, the storage unit 38 can be closed easily while all control means 42 remain in their neutral and unactuated positions.

Each control means includes a shaft 48 having top 50 and bottom 52 ends. Each control means 42 includes shifting means defined by the cam surfaces at the top and bottom ends 50 and 52. The cam surfaces are inclined relative to the vertical axis A for vertically moving all other control means 42 from their respective neutral positions to respective blocking positions in response to rotation of the control means 42 from the unactuated position to the actuated position like the centrally disposed control means 42 of FIG. 2.

Figure 5:
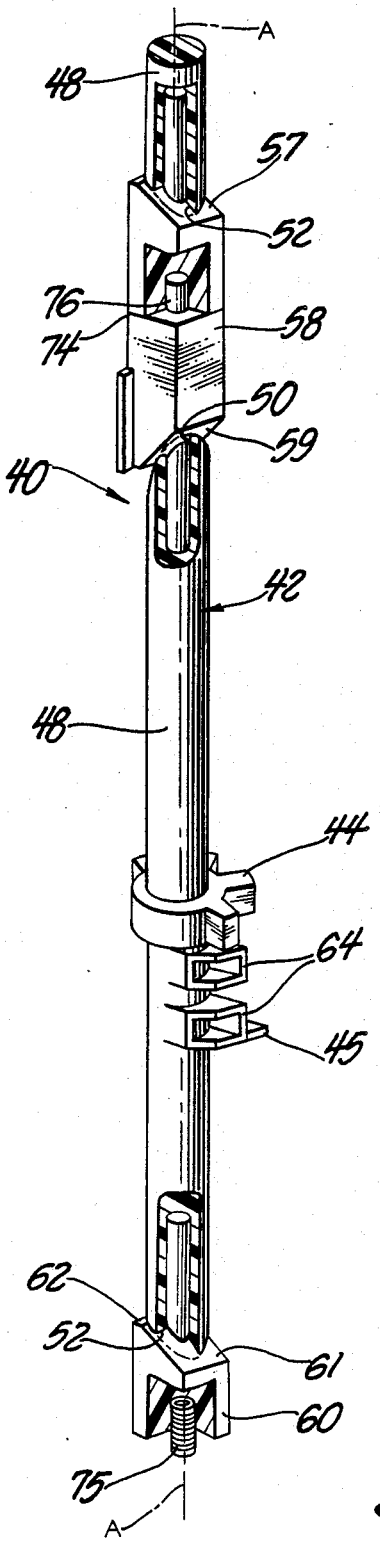
FIG. 5 is a fragmentary perspective view partially cut away and in cross section of a portion of the blocking means of the preferred embodiment illustrated in FIGS. 1 through 3.

The blocking means 40 also includes link means comprising a plurality of link elements 54, 56, 58 and 60, between next adjacent control means 42 and movably supported by the housing means 20 for vertical movement. The link means 54, 56, 58 and 60 are responsive to the cam surfaces 50 and 52 of the shifting means for vertically moving all of the control means 42 in response to rotation of one of the control means 42 (i.e., the center control means 42 in FIG. 2) from the unactuated position upon initial opening movement of the associated storage unit 38. Each of the link elements 54, 56, 58 and 60 present an inclined cam surface for mating surface-to-surface engagement with the cam surfaces 50 and 52 at the ends of the shafts 48 when the assembly is in the neutral position. The link element cam surfaces are illustrated in FIG. 5. The link element 56 includes a cam surface 57 which is inclined at the same angle and in mating surface engagement with the camming surface 52 at the bottom of the immediately adjacent shaft 48 when the assembly is in the unactuated position and all of the drawers are within the cabinet enclosure. In a similar fashion, the link element 58 has a cam surface 59 in surface-to-surface engagement with the top cam surface 50 of the adjacent shaft 48 when in the unactuated position. The link element 60 has an analogous cam surface 61. Accordingly, upon rotation of a shaft 48 of the control means 42, the cam surfaces 50 and 52 at the ends of the shaft 48 effect a wedging action with the adjacent cam surfaces of the adjacent link elements to vertically move the adjacent link elements. All of the cam surfaces terminate in a small horizontally disposed ledge 62, as shown at the bottom of FIG. 5. The ledges 62 rest upon one another when a shaft 8 has rotated to its fully actuated position, as illustrated by the centrally disposed shaft 48 and control means 42 of FIG. 2, for retaining the shaft 48 in the fully rotated or actuated position by frictional engagement between the ledges 62.

Each control means 42 includes lug means comprising a pair of vertically spaced lugs 64 extending radially from the shaft 48 for blocking engagement with the associated storage drawer unit 38 when in either of the upper and lower blocking positions, as illustrated by the top and bottom pairs of FIG. 2, and for rotating with the shaft 48 to the actuated position illustrated by the centrally disposed pair 64 of FIG. 2. A key means comprising a projection 66 extends from the housing means in vertical alignment with the space between the lugs 64 so that the projection 66 is disposed between the lugs 64 upon rotation of the shaft 48 by the pinion gear 44 from the unactuated position shown in FIG. 1 to the actuated position shown by the central control means 42 of FIG. 2. Accordingly, the projection 66 defines a key means which coacts between the housing means 20 and the control means 42 for limiting vertical movement of the control means 42 to the neutral position during rotation thereof between the unactuated and actuated positions as shown by the centrally disposed control means 42 of FIG. 2.

The limiting means 45 comprises a reversing tab connected to at least one lug 64. The tab 45 extends horizontally and laterally from the lug 64 and extends perpendicular to the axis of the links 54, 56, 58, 60 behind the lug 64 to contact and stop rotation of the control means 42 when the tab 45 contacts the vertical side beam 30. The pinion gear 44 is allowed to rotate to a point such that at least on gear tooth 43 will coact with the rack 46 when the storage unit 38 is moved toward open.

The assembly also includes guide means defined by the brackets 68 and 70 extending from the housing means 20 for preventing rotation of the link elements 54, 56, 58 and 60 about the vertical axis A while at the same time guiding vertical movement thereof. The brackets 68 are U-shaped but include an additional groove in the U-shaped pocket for receiving the laterally extending key 72 extending laterally from some of the link elements 54, 58, etc. for preventing removal of the link elements from the brackets 68. Other brackets 70 present closed openings through which the link elements are disposed. The link elements 54, 56, 58 and 60 have four-sided cross sections to coact with the brackets 68 and 70 to prevent rotation of the link elements about the vertical axis A. Specifically, the link elements are square in cross section. The link elements include a top element 54 or 58 engaging the top cam surface 50 of the control means 42 and a bottom element 56 or 60 engaging the bottom cam surface 52 of the control means 42. One of the top elements 54 or 58 mates with one of the bottom elements 56 or 60 at the division surfaces 34 between next adjacent housing sections or storage units or the openings therefor. In this manner, at least one shaft 48 and top 54, 58 and bottom 56, 60 elements are associated with each storage unit or opening in the housing enclosure. As best illustrated in FIG. 5, each shaft 48 has associated therewith a bottom element 60 or 56 and a top element 58 or 54 with there being a separation surface 74 between top and bottom link elements horizontally aligned in the unactuated position with the separation between vertically adjacent housing sections or compartments. As also shown in FIG. 5, each shaft 48 has a female bore extending into each end thereof and centrally disposed in the respective cam surfaces for receiving male pins extending from the cam surfaces of the adjacent link elements 54, 56, 58 and 60. In a similar fashion, a bore and pin axially align mating and engaging link elements as shown at 76.

A lost motion means comprising a spring 75 supports the stack of control means 42 and link elements in the vertically neutral positions and allows vertical movement of the link elements above and below each control means in opposite vertical directions in response to rotation of that control means to move all other link elements and control means to the blocking positions. This is best illustrated in FIG. 2 wherein the central control means 42 has been rotated to the actuated position raising the upper control means 42 upwardly as allowed by the lost motion space between the link element 54 and the top of the cabinet means and allowing the lower control means 42 to move downwardly compressing the spring 75. The spring 75 is of a sufficient spring weight to support the weight of all of the link elements and control means 42 in the neutral position for aligning the projections 66 with the spaces between the pairs of lugs 64. The spring 75 supports the lower most bottom link element 60 on the housing means 20 for up and down vertical movement thereof.

A spring 77 is disposed between the top link element 54 and the top of the housing for returning the control means 42 to the vertically neutral position. The spring force of the spring 77 is less than the spring 75. In fact, the spring 77, may be eliminated in some instances as gravity will return the stack to neutral.

The bottom 22 of the housing and a flange of the top of the housing define stop means for limiting the amount of vertical movement of the blocking means 40 for preventing simultaneous actuation of two of the control means 42 in response to simultaneous opening forces on two of the storage units 38. In other words, and as illustrated in FIG. 2, the upper link element 54 is prevented from moving upwardly any farther because of its butting engagement with the flange on the top of the housing enclosure and likewise the link element 60 at the bottom has fully compressed the spring 75 to engage the bottom of the housing, thereby limiting downward movement so that neither the upper shaft 48 nor the lower shaft 48 may be rotated thereby retaining the lugs 64 in the blocking positions illustrated and, further, preventing sufficient vertical movement to allow two of the shafts 48 to be rotated to the actuated position thereby preventing two drawers from being opened simultaneously.

A tab 78 extends from the side of each storage drawer unit as shown in phantom in FIG. 2. Each horizontally extending tab 78 is in vertical alignment with the space between the lugs 64 when in the neutral position. However, the tab 78 is aligned for blocking engagement with one of the lugs 64 when the lugs have been vertically shifted to one of the upper or lower blocking positions as in the case of the upper and lower control means 42 in FIG. 2.

The housing 20 would include slides or tracks 80 for slidably supporting the storage drawer units 38 in a fashion well known in the art.

The assembly also includes locking means independent of the blocking means 40 for vertically shifting all of the control means 42 to one of the blocking positions to prevent all of the storage drawer units 34 from being opened. The locking means may be of the type disclosed in U.S. patent application Ser. No. 058,028 filed June 4, 1987, copending and assigned to the assignee of this invention. Although not shown, a key lock assembly may be disposed in the front flange of the housing to coact with one of the notches (not numbered) in the locking bar 82 to raise the locking bar 82 to the locked position.

In regard to the operation, during the initial installment of a storage unit 38 within the housing means 20, the control means 42 will be biased in its unactuated and neutral position. This may be accomplished by the housing means 20 having any number of storage units therein in the closed position, or no storage units yet installed. When a storage unit is installed, the rack 46 of the unit will contact one of the gear teeth of the pinion 44 and ratchet the pinion without causing permanent rotation of the pinion. Therefore, during installation, the control means 42 remain in their unactuated and neutral positions, and when a storage unit is open the associated control means 42 moves to its actuated but neutral position while other control means 42 are moved to their blocking positions. The reversing tab 45 prevents the over rotation of the pinion gear 44 to ensure the pinion 44 and rack 46 will coact during opening of a storage unit 38.

Normally, the assembly is in the unactuated position illustrated in FIG. 1 wherein the vertical stack of link elements and control means 42 are supported in a vertically neutral position by the spring 75. In this vertically neutral position, the tabs 78 extending from each drawer are aligned with the space between the lugs 64 on the associated control means 42. Upon the opening of a storage unit or drawer 38, the rack 46 thereof engages the associated pinion 44 to rotate the shaft 48 thereby rotating the lugs 64 clockwise as viewed from the top with the projection 66 disposed therebetween as illustrated by the middle drawer opening of FIG. 2. The projection 66 knifes the lugs 64 to prevent any substantial vertical movement of the associated shaft 48 thereby allowing the tab 78 of the drawer to move between the lugs 64 and out of the opening. At the same time, the cam surfaces 50 and 52 effect a wedging action with the cam surfaces of the adjacent link elements to vertically move the adjacent link elements up and down as the case may be. The link elements are prevented from being rotated and are therefore forced upwardly and downwardly depending upon whether they are disposed above or below the rotated shaft 48. As illustrated in FIG. 2, the top shaft 48 is moved vertically upwardly because of the coaction between the camming surface 50 at the top end of the middle shaft 48 and the next above link element 58 to thereby move the lowermost lug 64 into blocking engagement with the tab 78 on the adjacent top drawer. Accordingly, the drawer or storage unit 38 of the top opening in FIG. 2 is preventing from moving outwardly to the open position. In a similar but opposite position, the lower camming surface 52 of the middle shaft 48 moves the next adjacent link element 56 downwardly to move the lowermost shaft 48 downwardly to move the lug means 64 to the lower blocking position with the tab 78 on the adjacent or bottom drawer preventing it from being opened and moving the top lug 64 of the pair into horizontal blocking alignment with the adjacent or lowermost projection 66. The shaft 48 rotated to the actuated position is rotated approximately 180° as shown by the middle shaft in FIG. 2 so that the horizontal shelf surfaces 62 rest upon one another to frictionally hold the shaft 48 in the rotated actuated position. When the drawer 38 is returned to the closed position, the rack 46 thereof engages the pinion gear 44 to rotate the shaft 48 in the counterclockwise direction as viewed from the top to return the assembly to the unactuated vertically neutral position. The reversing tab will prevent over-reverse rotation of the pinion. The space for vertical movement of the entire stack of elements is limited by the space between the uppermost link element 54 and the housing and the space between the lowermost link element 60 and the housing whereby there is not sufficient room to rotate two of the shafts 48 at the same time.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A storage assembly comprising: housing means (20) defining an enclosure, a plurality of storage units (38) to be supported by said housing means (20) for movement between a closed position within the enclosure and an open position extending out of said housing means, and blocking means (40) disposed along side of said storage units (38) for preventing opening movement from said closed position of all but one of said storage units (38) in response to opening movement of said one of said storage units (38), said blocking means (40) including control means (42) associated with each storage unit (38) movable between a neutral position allowing opening movement of said storage unit and a blocking position preventing opening movement of said storage unit from said closed position and for remaining in said neutral position during installation of any number of storage units from their open position to their closed position while allowing opening movement of one installed storage unit (38) from its closed position moving all other control means to said blocking position preventing opening movement of all other associated storage units (38).

2. An assembly as set forth in claim 1 further characterized by each control means including transmission means coacting with the associated storage unit for rotating said control means between an actuated position during installation of any number of said storage units and when in said closed position and an actuated position when in extended open position such that said control means is in said neutral and actuated positions during opening thereof placing all other control means in said blocking and unactuated positions and being in said neutral and unactuated position during installment thereof.

3. An assembly as set forth in claim 1 further characterized by said control means including limiting means for preventing said transmission means from moving out of coacting engagement with said storage means and out of said neutral and unactuated positions when rotating from said actuated position to said unactuated position and during initial installation of said storage unit (38) .

4. An assembly as set forth in claim 3 further characterized by said transmission means comprising; a pinion gear (44) having a circumference and rotating between an unactuated position and actuated position when said control means is in said neutral position when the associated storage unit is being opened, and a pinion rack (46) extending from each storage unit (38) for engaging and rotating said pinion gear (44) of the associated control means (42) to said actuated position during opening movement thereof while disengaging during initial installation thereof.

5. An assembly as set forth in claim 4 further characterized by said pinion gear (44) comprising gear teeth on less than the full circumference of said pinion gear (44).

6. An assembly as set forth in claim 5 further characterized by said limiting means (45) comprising reversing tab acting against said housing means (20) for preventing said pinion gear (44) from rotating out of said unactuated and coacting position except in response to initial opening movement of said storage unit (38).

7. An assembly as set forth in claim 6 further characteriZed by each control means (42) including lug means (64) extending radially for blocking engagement with the associated storage unit (38) when in said blocking position and for rotating with said control means (42) to said actuated position, said reversing tab (45) extending laterally therefrom.

8. An assembly as set forth in claim 7 further characterized by each control means (42) including shifting means (50, 52) for vertically moving all control means (42) thereabove upwardly from their respective neutral positions to respective blocking positions in response to rotation of said control means (42) from said unactuated position to said actuated position and for vertically moving all control means (42) therebelow downwardly from their respective neutral positions to respective blocking positions in response to rotation of said control means (42) from said unactuated position to said actuated position.

9. An assembly as set forth in claim 8 further characterized by said transmission means including key means (66) coacting between said housing means (20) and said lugs (64) for limiting vertical movement of said control means (42) to said neutral position during rotation thereof between said unactuated and actuated positions.

10. An assembly as set forth in claim 9 further characterized by said control means (12) including a shaft (48), said lug means comprising a pair of vertically spaced apart lugs (64) extending radially from said shaft (48) and said key means comprises a projection (66) extending from said housing means (20) in vertical alignment with the spaced between said lugs (64) so that said projection (66) is disposed between said lugs (64) upon rotation of said shaft (48) by said pinion gear (44) from said unactuated position.

11. An assembly as set forth in claim 10 further characterized by said blocking means (40) including link means (54, 56, 58, 60) movably supported by said housing means (20) for vertically moving all of said control means (42) in response to rotation of one of said control means (42) from said unactuated position upon initial opening movement of the associated storage unit (38).

12. An assembly as set forth in claim 11 further characterized by said link means including a plurality of link elements (54, 56, 58, 60) between next adjacent control means (42); said elements mating and being separable at a division (34) between next-adjacent storage units (38) so that the blocking means (40) may be of variable lengths to accommodate various numbers of storage units (38).

13. An assembly as set forth in claim 12 further characterized by said link means and said control means (42)

being of different vertical dimensions to accommodate storage units (38) of various different vertical dimensions.

14. An assembly as set forth in claim 13 further characterized by said key means (66) coacting with said lug means (64) during rotation of said control means (42) from said unactuated position to said actuated position for limiting said vertical movement of the associated control means (42) during rotational movement thereof.

15. An assembly as set forth in claim 14 further characterized by including guide means (68, 70) extending from said housing means (20) for preventing rotation of said link means (54, 56, 58, 60) about said vertical axis (A) while guiding vertical movement thereof.

16. An assembly as set forth in claim 15 further characterized by including lost motion means (75) for supporting the stack of control means (42) and link means (54, 56, 58, 60) in said vertically neutral positions and for allowing vertical movement of the link means above and below each control means (42) in opposite vertical directions in response to rotation thereof to move all other link means and control means (42) to said blocking positions.

17. An assembly as set forth in claim 16 further characterized by each control means (42) including a shaft (48) having top (50) and bottom (52) ends, said shifting means comprising cam surfaces at said top and bottom ends and inclined relative to said vertical axis (A) for effecting a wedging action with the adjacent link means (54, 56, 58, 60) to vertically move same.

18. An assembly as set forth in claim 17 further characterized by said link means including a top link element (54, 50) engaging said top cam surface (50) and a bottom link element (56, 60) engaging said bottom cam surface (52).

19. An assembly as set forth in claim 18 further characterized by each of said top and bottom elements having a four-sided cross section to coact with said guide means (68, 70) to prevent rotation of said elements about said vertical axis (A).

20. An assembly as set forth in claim 19 further characterized by one (58, 58') of said top elements mating with one (56, 56,) of said bottom elements at the division (34) between next-adjacent storage units so that a shaft (48) and top and bottom elements are associated with each storage unit (38).

21. An assembly as set forth in claim 20 further characterized by said lost motion means comprising a spring (75) supporting the lower-most bottom element (60) on said housing means (20) for up and down vertical movement of said lower-most bottom element (60).

22. An assembly as set forth in claim 21 further characterized by including a tab (78) extending from each storage unit (38) in vertical alignment with the space between said lugs (64) when in said neutral position and aligned for blocking engagement with said lugs (64) when in said blocking position.

23. An assembly as set forth in claim 22 further characterized by including stop means limiting the amount of vertical movement of said blocking means (40) for preventing simultaneous actuation of two of said control means (42) in response to simultaneous opening forces on two of said storage units.

24. A storage assembly comprising: a housing means (20) defining an enclosure; a plurality of storage units (38) to be supported by said housing means (20) for movement between a closed position within the enclosure and an open position extending out of said housing means; and blocking means (40) along side of said storage units (38) for preventing opening movement from said closed position of all but one of said storage units (38) in response to opening movement of said storage units (38); said blocking means (40) including control means (42) associated with each storage unit (38) coacting with the associated storage unit for rotating said control means between an unactuated position when the associated storage unit is closed and actuated position preventing opening movement thereof when another storage unit is moving toward open, and reversing tab connected to said control means and acting against said housing means (20) for preventing said control means from rotating out of said unactuated position except in response to said storage unit moving to said open position rotating said control means to said actuated position.

25. An assembly as set forth in claim 24 further characterized by each control means (42) including shifting means (50, 52) for vertically moving all control means (42) thereabove upwardly from respective neutral positions allowing opening movement of said storage unit to respective blocking positions preventing opening movement of said storage unit response to rotation of said control means (42) from said unactuated position to said actuated position and for vertically moving all control means (42) therebelow downwardly from their respective neutral positions to respective blocking positions in response to rotation of said control means (42) from said unactuated position of said actuated position.

26. An assembly as set forth in claim 25 further characterized by said control means (42) including transmission means for rotating between said unactuated and actuated position, said transmission means comprising; a pinion gear (44) having a circumference and rotating between said unactuated position and said actuated position when said control means is in said neutral position when the associated storage unit is being opened, and a pinion rack (46) extending from each storage unit (38) for engaging and rotating said pinion gear (44) of the associated control means (42) to said actuated position during opening movement thereof while disengaging during initial installation thereof, said reversing tab acting against said housing means (20) for preventing said pinion gear (44) from rotating out of said unactuated and coacting position except in response to initial opening movement of said storage unit (38).

27. An assembly as set forth in claim 26 further characterized by said pinion gear (44) comprising gear teeth on less than the full circumference of said pinion gear (44).

28. An assembly as set forth in claim 27 further characterized by each control means (42) including lug means (64) extending radially for blocking engagement with the associated storage unit (38) when in said blocking position and for rotating with said control means (42) to said actuated position, said reversing tab (45) extending laterally therefrom.

29. An assembly as set forth in claim 28 further characterized by said lug means comprising a pair of vertically spaced lugs (64) extending radially from said shaft (48) and said key means comprises a projection (66) extending from said housing means (20) in vertical alignment with the space between said lugs (64) so that said projection (66) is disposed between said lugs (64) upon rotation of said shaft (48) by said pinion gear (44) from said unactuated position.

30. An assembly as set forth in claim 29 further characterized by said transmission means including key means (66) coacting between said housing means (20) and said lugs (64) for limiting vertical movement of said control means (42) to said neutral position during rotation thereof between said unactuated and actuated positions.

* * * * *